United States Patent [19]

Keijser

[11] 3,935,815

[45] Feb. 3, 1976

[54] INKING APPARATUS FOR PRINTING PRESS

[75] Inventor: Karl Olov Keijser, Vasteras, Sweden

[73] Assignee: AB Printing Equipment, Sollentuna, Sweden

[22] Filed: Mar. 12, 1975

[21] Appl. No.: 557,833

Related U.S. Application Data

[63] Continuation-in-part of Ser. No. 453,865, March 22, 1974, abandoned, which is a continuation of Ser. No. 297,238, Oct. 13, 1972, abandoned.

[30] Foreign Application Priority Data

Oct. 21, 1971 Sweden ..... 13371/71

[52] U.S. Cl. ..... 101/349; 101/247

[51] Int. Cl.[2] ..... B41F 31/30

[58] Field of Search ..... 101/348–352, 101/247

[56] References Cited

UNITED STATES PATENTS

| | | | |
|---|---|---|---|
| 542,369 | 7/1895 | Meisel | 101/349 |
| 643,372 | 2/1900 | Cornwall | 101/349 |
| 2,162,812 | 6/1939 | Harrold et al. | 101/351 |
| 2,387,750 | 10/1945 | Davidson | 101/350 |
| 2,751,843 | 6/1956 | Faeber | 101/349 |
| 2,853,943 | 9/1958 | Royer | 101/247 |
| 2,972,299 | 2/1961 | DeMarchi | 101/349 |
| 3,186,338 | 6/1965 | Peyreburne et al. | 101/352 |
| 3,295,442 | 1/1967 | Allen | 101/349 |
| 3,304,863 | 2/1967 | Jurny | 101/351 |
| 3,433,155 | 3/1969 | Norton | 101/349 |
| 3,440,958 | 4/1969 | Benda et al. | 101/349 |
| 3,448,686 | 6/1969 | Bohman | 101/349 |
| 3,491,686 | 1/1970 | Zurick | 101/352 |
| 3,538,849 | 11/1970 | Bohman | 101/352 |

FOREIGN PATENTS OR APPLICATIONS

| | | | |
|---|---|---|---|
| 454,953 | 5/1928 | Germany | 101/349 |

*Primary Examiner*—Edgar S. Burr
*Assistant Examiner*—William Pieprz
*Attorney, Agent, or Firm*—Ostrolenk, Faber, Gerb & Soffen

[57] ABSTRACT

An inking apparatus for printing presses wherein inking rolls are mounted so that adjustment of one of the rolls does not disturb the mutual setting and adjustments of the remaining rolls; this is achieved by means of three form rolls contacting two distribution rolls at four contact points; various roll position adjustment means are disclosed for accomplishing the adjustments noted.

5 Claims, 10 Drawing Figures

INKING APPARATUS FOR PRINTING PRESS

This is a continuation-in-part of application Ser. No. 453,865, filed Mar. 22, 1974, which is, in turn, a continuation of application Ser. No. 297,238, filed Oct. 13, 1972, both now abandoned.

The invention is directed to printing presses in general and to an inking apparatus in particular. The invention is directed to obtaining a uniform ink supply in a printing press and to delivering same to the printing form, thereby to produce a print on which the ink is uniformly dispersed.

In conventional printing presses, for obtaining uniform ink dispersal, it is conventional to provide an inking apparatus that is comprised of a number of rolls, which take ink up from an ink reservoir and transfer the ink to the printing form. Ink is taken from the rolls in the inking apparatus in a uniform, extremely thin layer, which is then transferred to the printing form in an amount corresponding to approximately 50 mg/cm$^2$ for a fully covered, black surface.

Extremely small variations in the quantity and/or thickness of ink on the finished printed matter can be discerned by the viewer's eye. Thus, there are extremely high requirements for an inking apparatus to obtaining a uniformly inked print. To obtain the necessary exact, uniform dispersion of ink, the inking rolls must be extremely accurately aligned and parallel in relation to each other and to the printing form, specifically with respect to the pressure exerted between the rolls themselves and between the rolls and the printing form. Normally, it is not possible to satisfy these precise requirements through the connection of springs to the rolls. In known apparatus of this type, the rolls are normally journaled in the frame of the printing press and adjustments in the pressure exerted by the rolls and their alignment are typically corrected and adjusted by means of set screws on each roll, which bear against bearing cups or bearing housings for the roller trunnions. Each roll is individually adjusted. Depending upon the type of press involved, the inking apparatus may include as many as 10 to 15 rolls, and when one roll is adjusted, the remaining rolls must be correspondingly adjusted, at least in a direction away from the adjusted roll. Obviously, such adjustments are time consuming and expensive.

The present invention provides an inking apparatus, wherein one inking apparatus roll can be finely adjusted or repositioned with respect to the other rolls without requiring adjustment of the remaining rolls and the mutual setting of the remaining rolls may remain unchanged, without affecting their pressure or alignment. To accomplish this, the invention includes a novel roll suspension structure.

A preferred form of the invention comprises a single ink transfer roll for transferring ink from an ink reservoir, two separated distributing rolls both in contact with the transfer roll and three form rolls arrayed about the outside of the printing form. The leading and trailing form rolls each respectively engage one of the distribution rolls and the central form roll engages both of the distribution rolls, whereby there are four contact points between the distribution and the form rolls.

The first one of the distributing rolls is rotatable about a first stationary axis. The second distributing roll is journaled for rotation in a first arm, and that first arm is swingable about a second axis, offset from the first axis. The central form roll and one of the other form rolls are journaled for rotation in respective second and third swingable arms, both of which arms are swingable about the axis of the second distributing roll. The third form roll is journaled for rotation in a fourth arm, and the fourth arm is swingable mounted about the first axis. The transfer roll sits atop and between the distributing rolls.

Adjustment means are provided for selectively adjusting the form rolls in position so that the transfer roll, together with the two distributing rolls and together with any one of the three form rolls retain their positions relative to one another and their axes define a quadrangle.

Accordingly, it is the primary object of the invention to provide an inking apparatus for a printing press to enable uniform dispersal of ink across a print form.

It is a further object of the invention to provide an inking apparatus employing transfer, distributing and from rolls, wherein the position of one of the rolls can be adjusted with respect to that of the other rolls, without thereafter requiring adjustments in the position of the other rolls.

It is a further object of the invention to minimize the number of distributing rolls to maintain contact between the distributing and form rolls in an inking apparatus.

These and other objects of the invention will become apparent from the following description of the accompanying drawings, in which.

Figure 1:
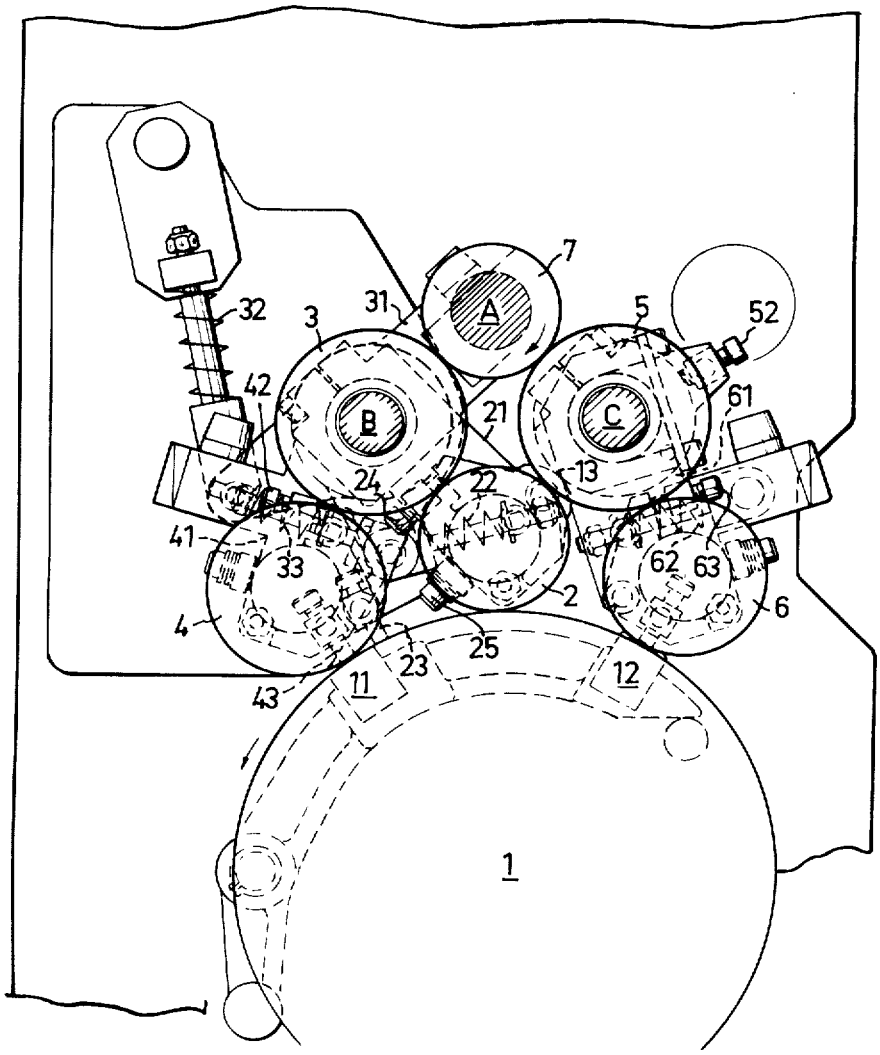
FIG. 1 shows a portion of an inking apparatus employed in an offset printing press and embodying the principles of the present invention.
Figure 2:
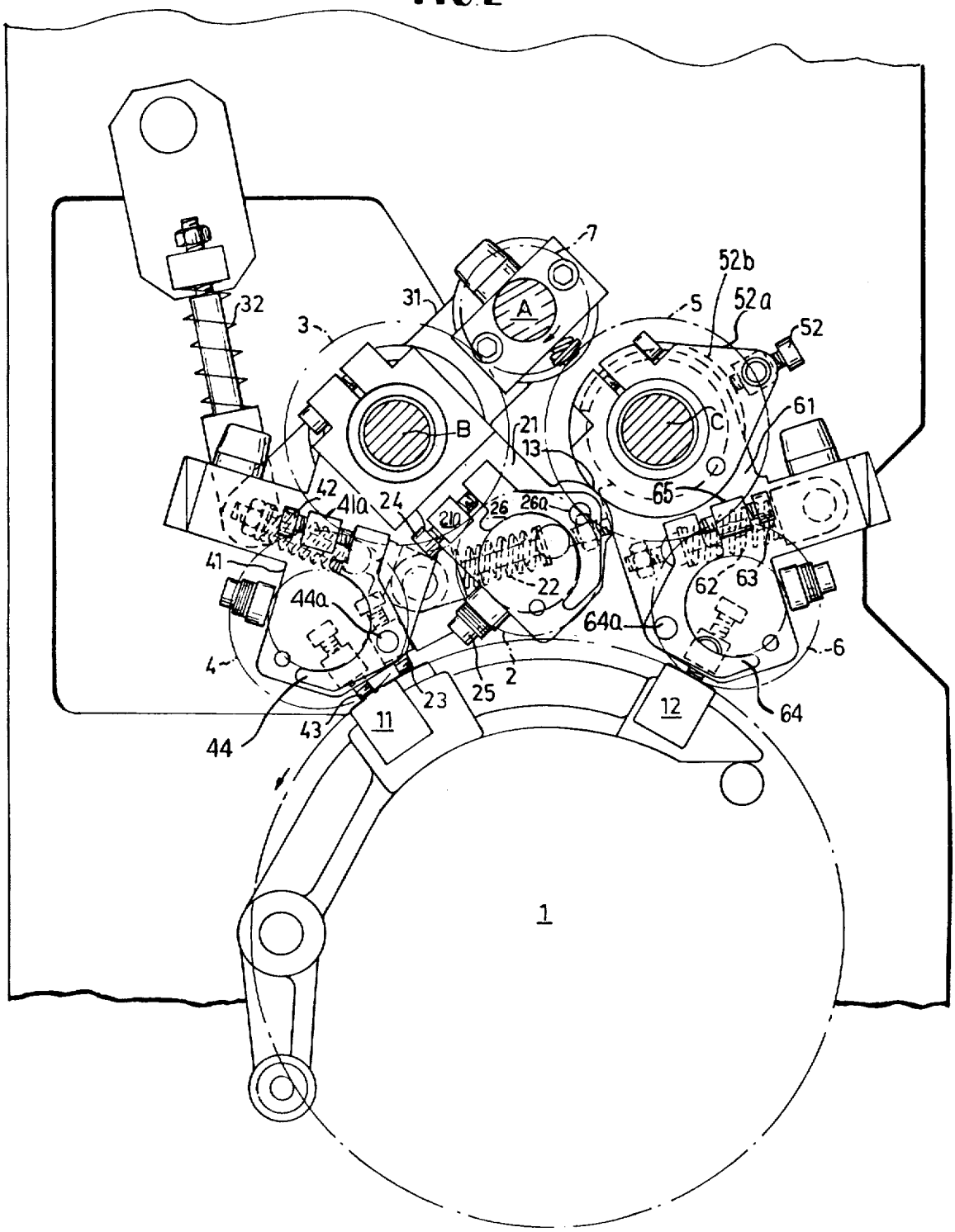
FIG. 2 shows the arrangement of FIG. 1 with some of the hidden elements of FIG. 1 being shown in solid line form to facilitate understanding of the invention.

Turning to the drawings, in FIGS. 1 and 2, there is shown cylinder 1 that is formed of sheet metal and on which the substrate to be printed can be carried. Associated with the cylinder 1 is an inking apparatus which includes the form rolls 2, 4 and 6 that engage the cylinder 1, the distributing rolls 3 and 5 that engage the form rolls and the transfer roll 7 which engages the distributing rolls 3 and 5. The inking apparatus also includes roll 71 and five additional rolls (not shown) that would be located before roll 7 for delivering ink thereto.

Figure 4:
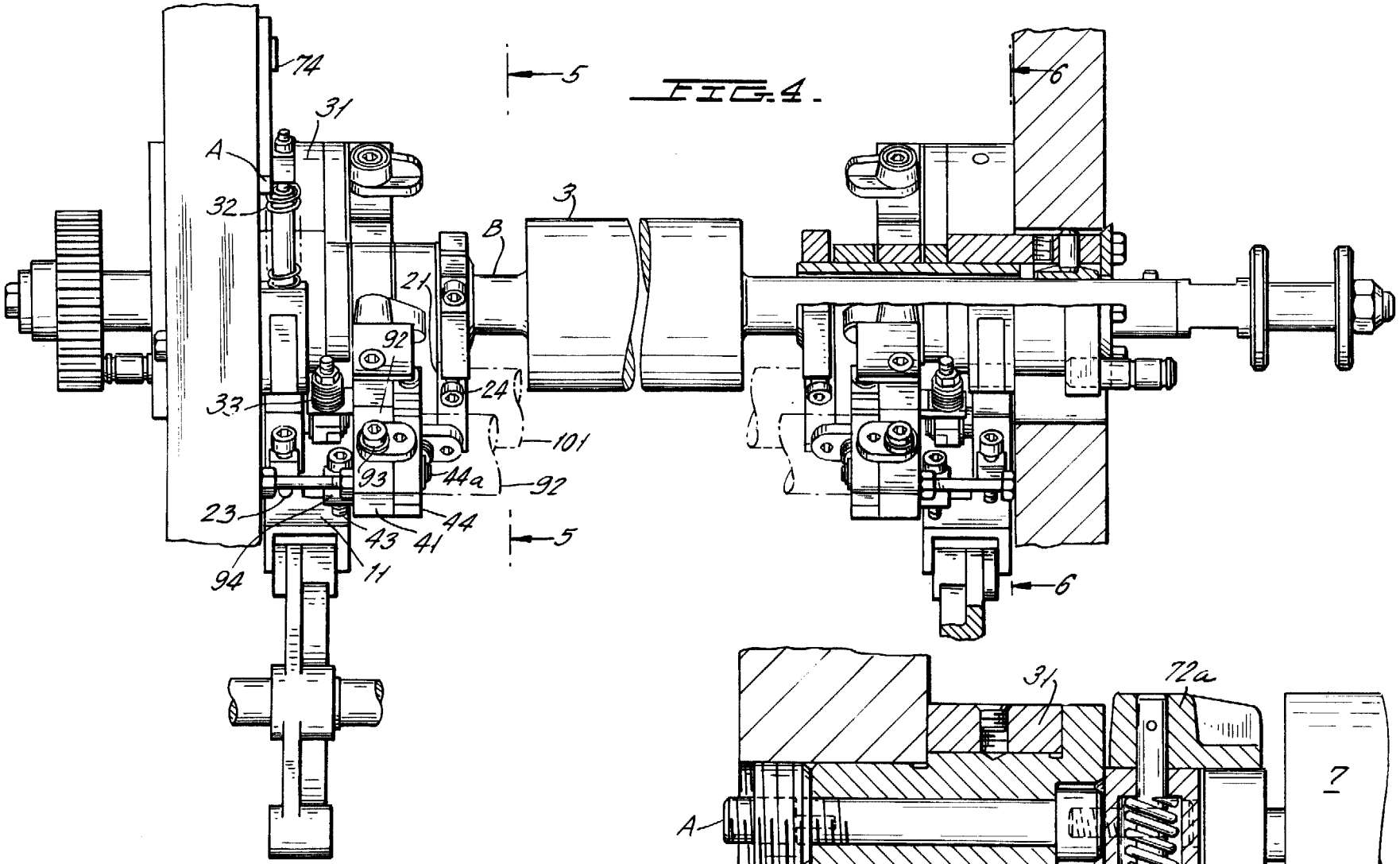
FIG. 4 is a front elevational view, from the left in FIG. 2, of the inking apparatus.
Figure 7:
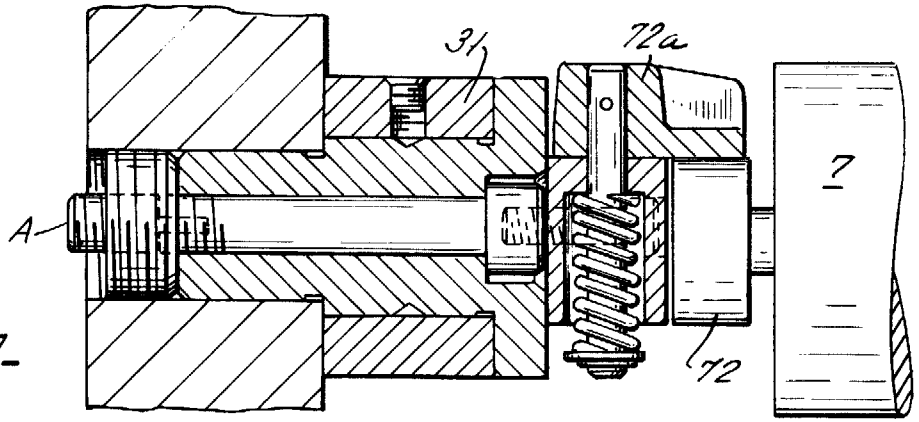
FIG. 7 is a cross-sectional view along the line and in the direction of arrows 7 in FIG. 5, showing the mounting of one of the rolls in the inking apparatus.
Figure 6:
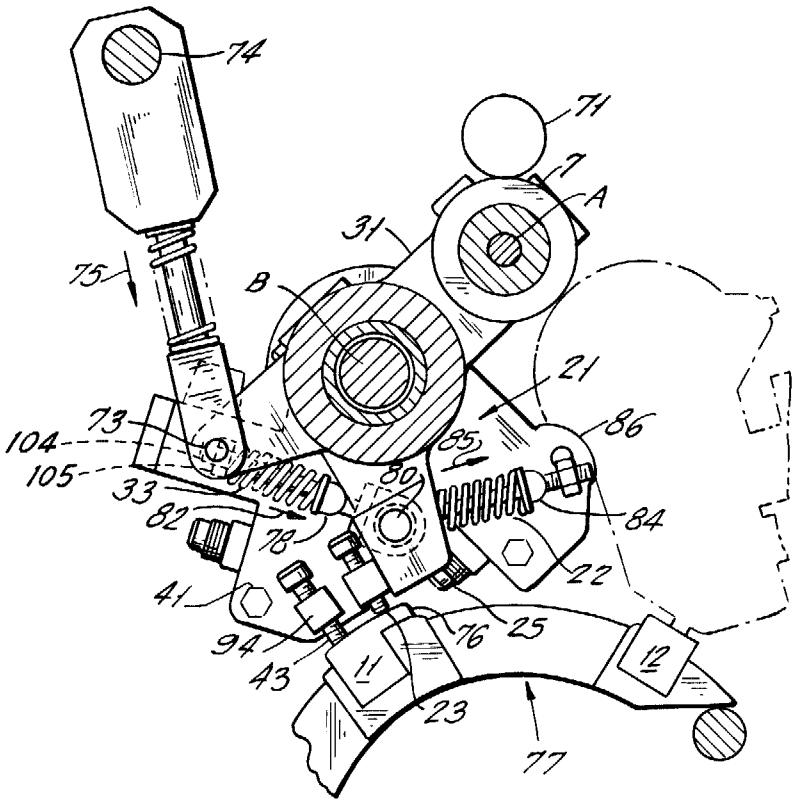
FIG. 6 is another side elevational view, along the line and in the direction of arrows 6 in FIG. 4.
Figure 5:
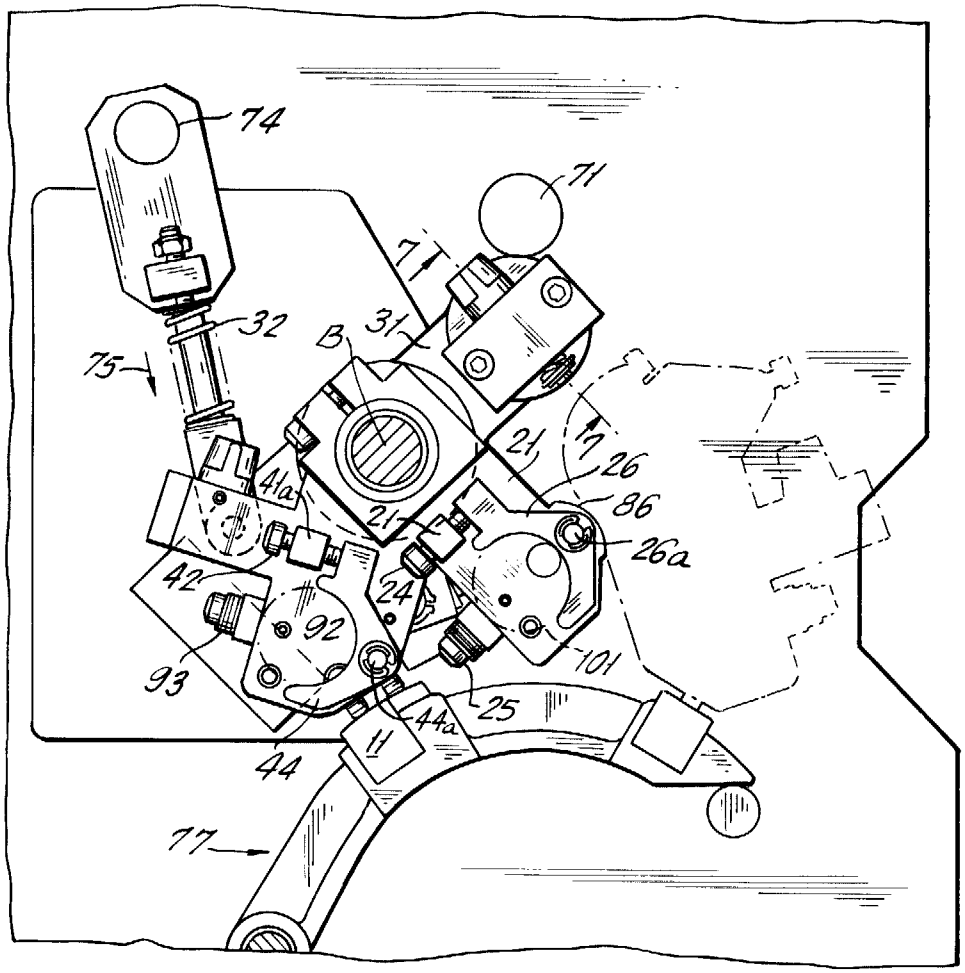
FIG. 5 is a side elevation view, along the line and in the direction of arrows 5 in FIG. 4.
Figure 8:
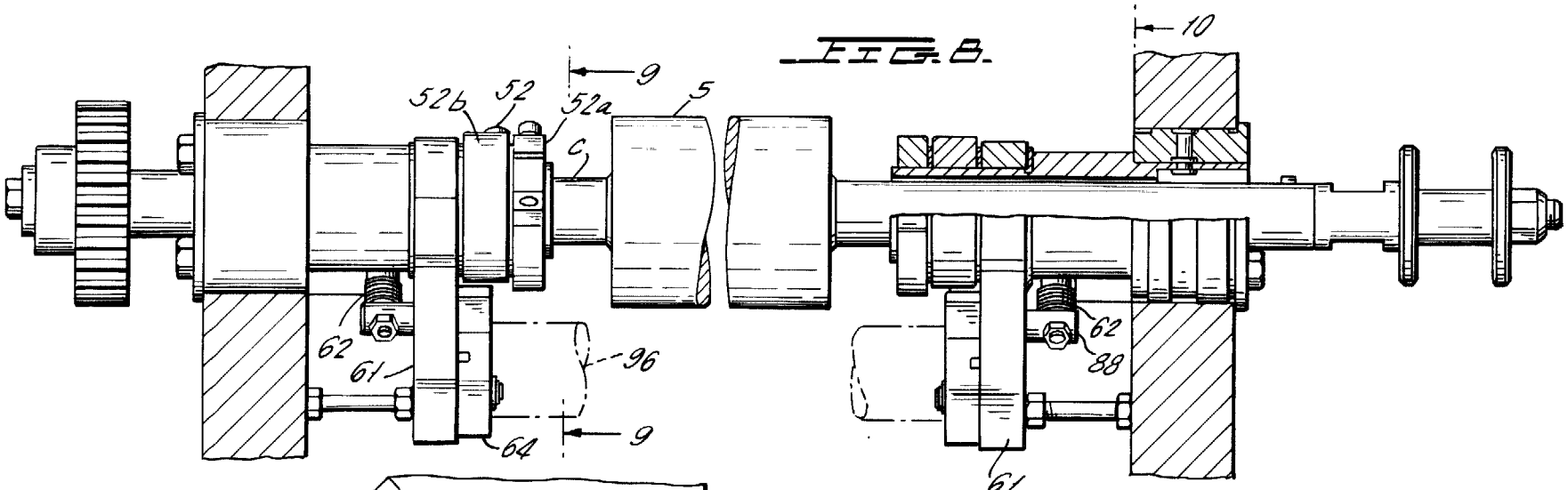
FIG. 8 is a rear elevational view, from the opposite direction from FIG. 4, of the inking apparatus.
Figure 10:
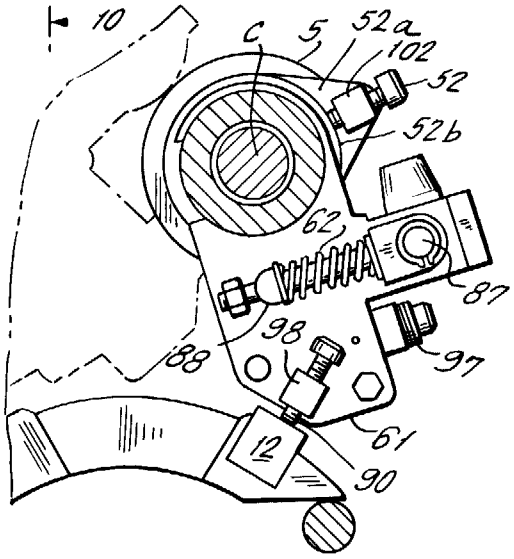
FIG. 10 is another side elevational view, along the line and in the direction of arrows 10 in FIG. 8.
Figure 9:
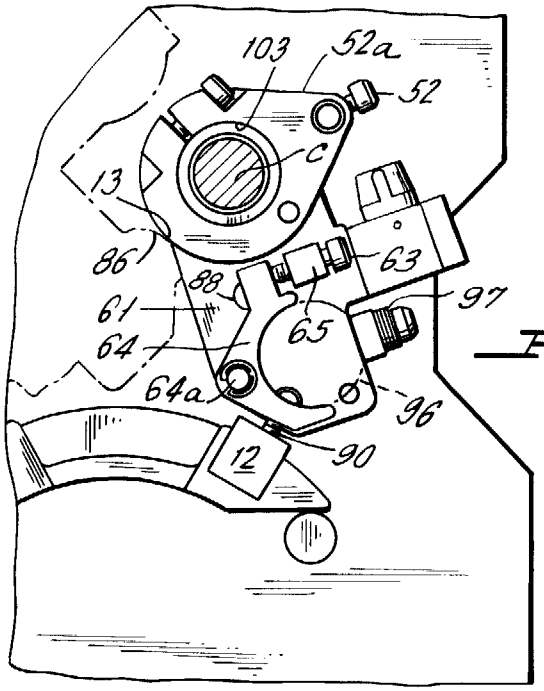
FIG. 9 is a side elevational view, along the line and in the direction of arrows 9 in FIG. 8.

As suggested in FIGS. 4 and 8, the rolls 2–7 are elongated, extend across the elongated cylinder 1 and are generally parallel to each other for uniform ink dispersion. Alongside of all of the rolls and of the cylinder 1 are the various elements and structures of which the invention is comprised and which enable the objects of the invention to be realized.

The inking apparatus includes two fixedly positioned pivot axes A, shown in FIGS. 1–4, 6 and 7, and C, shown in FIGS. 1–3, 8–10, both of which are carried on the frame of the printing press and the positions of which are not movable with respect to cylinder 1. Pivot C is closer to cylinder 1 than is pivot A and is angularly offset with respect to cylinder 1 from pivot A. The roll 5 is journaled on the axis C and is rotatable thereabout but is otherwise nonmovable with respect thereto.

Suspended from pivot A and rotatable thereabout is arm 31 (FIGS. 1, 2, 4–7). Spaced from pivot A and more centrally located along arm 31 is a pivot axis B (FIGS. 1–6). Pivot B is normally closer to cylinder 1 than pivot A and is angularly offset with respect to cylinder 1 from pivot A and is also angularly offset with respect to cylinder 1 on the other side of pivot A from pivot C. Roll 3 (FIGS. 1–4) is journaled on arm 31 at pivot B and roll 3 rotates with respect to arm 31. Roll 3 rests upon and presses against rolls 2 and 4.

From pivot B is suspended a first arm 21 (FIGS. 1, 2, 4–6) which is pivotable about pivot B and which extends to the axis of roll 2. Roll 2 (FIGS. 1–3) is journaled on arm 21 and is rotatable with respect to that arm.

An arm 61 (FIGS. 1, 2, 8–10) is journaled to pivot about pivot C and extends to the axis of roll 6. Roll 6 (FIGS. 1–3) is journaled on arm 61 and is rotatable with respect to that arm.

Roll 5 (FIGS. 1–3, 8) rests on and presses against rolls 2 and 6.

Ink transfer roll 7 (FIGS. 1–3, 5–7) rests on the peripheries of rolls 3 and 5. Inking roll 71 (FIGS. 5–6) and/or other inking rolls in the train of rolls presses roll 7 against rolls 3 and 5. In the drawings, roll 7 appears to be coaxial with pivot A. But roll 7 is actually free of any direct connection with pivot A (see FIG. 7). A ball bearing support 72 for roll 7 is provided. It includes a spring loaded cap 72*a* to absorb shifting of roll 7 due to position changes of roll 3.

The axis of roll 7 substantially coincides with pivot A. However, it is freely movable in relation to pivot A due to the automatic self-adjustment in the position of roll 7 by means of an adjustment in the positions of roll 3 and of the ink supplying roll 71 and the spring load on the ball bearing 72.

In addition to the roll supporting arms discussed above, other means have been provided to maintain the various rolls at their desired locations and to adjust their positions.

There is connected at pivot point 73 on arm 31 (FIG. 6) one end of helical spring 32. At its other end, spring 32 is pivotally connected at 74 to the frame of the printing press. Spring 32 exerts a biasing force in the direction of arrow 75 urging arm 31 to pivot counterclockwise. At the base of arm 31 is located the adjustable, abutment set screw 23 which is biased by spring 32 to engage first stop 76 for arm 31, which stop is part of stop assembly framework 77 alongside cylinder 1. This positions arm 31 and roll 2.

Figure 3:
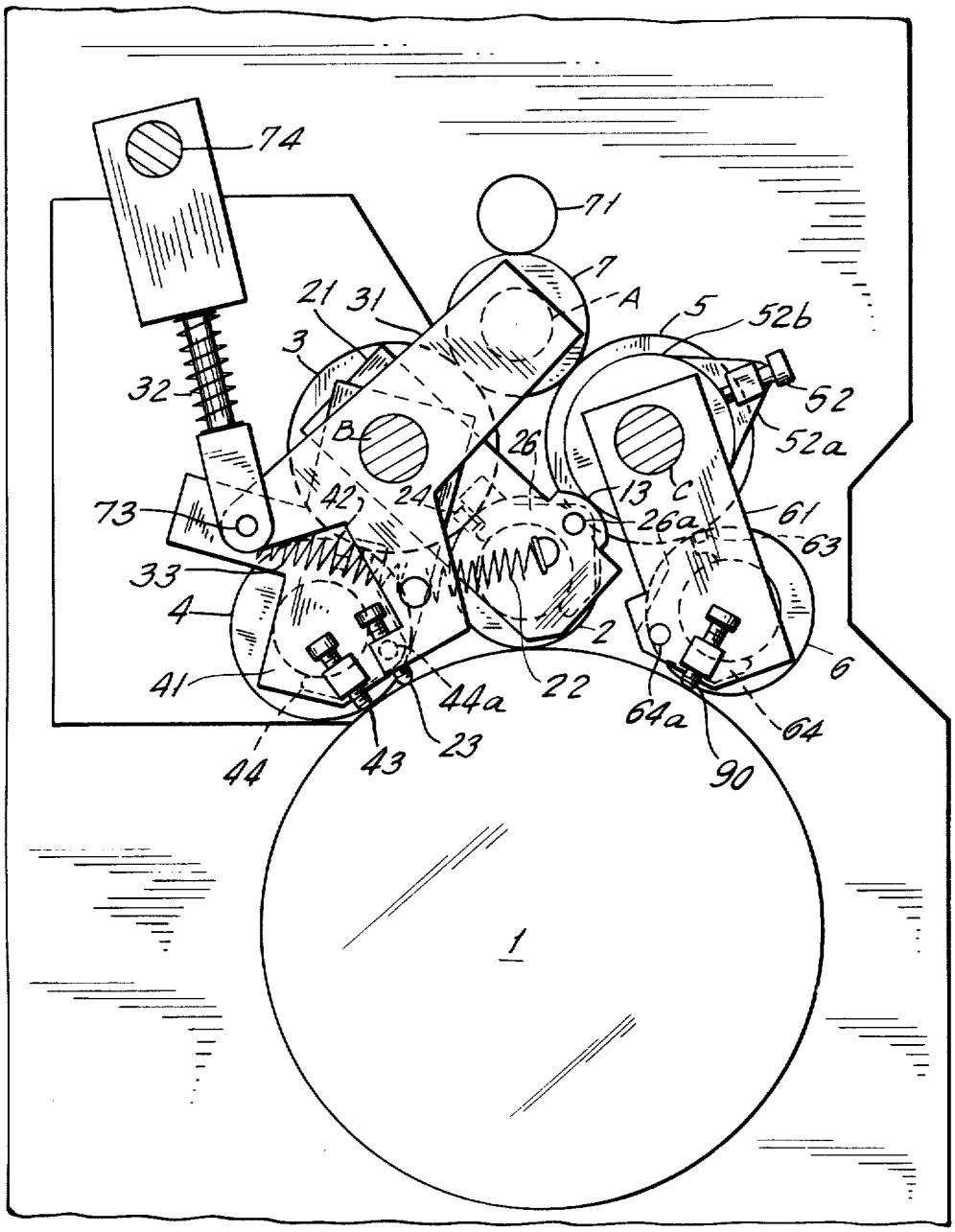
FIG. 3 is a highly simplified schematic arrangement showing the rollers of FIGS. 1 and 2.

Arm 41 is normally biased to pivot counterclockwise in FIGS. 1–3 by means of helical tension spring 33. At rounded abutment 78 which projects from arm 41 (FIG. 6), spring 33 engages abutment 78 and thus arm 41. At common pivot connection 80 located on arm 31, spring 33 is journal connected through shaft 104 having abutment 105 thereon to arm 31. The normal bias of spring 33 exerts force in the direction of arrow 82 against abutment 78 and this pivots arm 41 counterclockwise. (At the same time, this would tend to pivot arm 31 clockwise, but spring 32 pivots arm 31 counterclockwise.) Attached at the base of arm 41 is a below described stop engaging abutment set screw 43 which is biased into engagement with stop 11 on the framework 77. This positions arm 41 and roll 4.

Because of its connection to pivot B by arm 21, roll 2 is biased by spring 32 against the surface of cylinder 1. In addition, compression spring 22 extends between common pivot 80 on arm 31 and rounded abutment 84 on arm 21 and exerts force in the direction of arrow 85 upon arm 21 to drive the rounded stop engaging abutment surface 86 (FIGS. 5 and 6) against below described stop 13 which is associated with roll 5 on arm 61. Hence, the position of roll 2 is determined by engagement of abutment set screw 43 with stop 11 and engagement of surface 86 with stop 13. Roll 2 is thereby spring biased against both of rolls 1 and 5.

Roll 3 is biased by means of spring 32 acting on roll 3 support arm 31 toward both of rolls 2 and 4 and thereby is supported by and biased toward stop 11.

A spring 62 is pivotally connected at one end at 87 to a fixed abutment 89 on the frame of the apparatus, and at the other end is affixed to an abutment 88 on arm 61. Spring 62 normally biases arm 61 clockwise as viewed in FIGS. 1–3, 9 and 10, such that the stop engaging abutment set screw 90 is biased against stop 12 of the framework alongside cylinder 1.

As noted above, roll 5 remains stationary in its position about and pivots about axis C. Roll 7 is simply pressed by roll 71 against the peripheries of rolls 3 and 5.

In accordance with a basic concept of the invention, any of the form rolls 2, 4 and 6 can be adjusted in its position with respect to cylinder 1 without any adjustment in the position of any of the other form rolls and without requiring adjustment in the position of either of the distribution of transfer rolls.

For adjusting the position of roll 4, its circular axle 92 (FIGS. 2, 4, 5) has located about its periphery the bearing box 44 which has a substantially semi-circular opening therein for receiving the axle 92. The counter screw 93 supported (by means not shown) on the frame of the printing apparatus presses the axle 92 firmly into the semi-circular opening of bearing box 44. At the middle of bearing box 44 is defined a pivot 44*a* about which bearing box 44 is swingable. As a result of such swinging of bearing box 44, the location of axle 92 and thereby of roll 4 is adjusted. For causing swinging motion of bearing box 44, a set screw 42 threadedly passes through the projection 41*a* on arm 41 and bears against one end of the bearing box 44. Tightening and loosening of screw 42 swings bearing box 44 around its pivot. The swing of the bearing box causes corresponding swinging of the axle 92 and also causes corresponding pivoting of arm 41, but this would have no effect upon the position of any of the other rolls. It is the purpose of screw 42 to adjust the relationship and position of roll 4 with respect to roll 3.

A further control over the position of roll 4 with respect to cylinder 1 is obtained by means of set screw 43 which threadedly passes through projection 94 on arm 41 and at its end abuts stop 11. Tightening and loosening of screw 43 adjusts the position of roll 4. It is the purpose of screw 43 to adjust the pressure against cylinder 1 of roll 4.

The position of roll 6 is adjusted with respect to cylinder 1 in a manner quite similar to the adjustments in the position of roll 4. Roll 6 is provided with its own bearing box 64 into whose substantially semi-circular opening the axle 96 of roller 6 is forced by counter screw 97 which is also supported (by means not shown) on the frame of the apparatus. Bearing box 64 is carried on its central pivot 64*a* on the arm 61 and box 64 is swingable about its pivot. Set screw 63 threadedly passes through projection 65 on arm 61 and there engages the end of the bearing box 64. By tightening and loosening of screw 63, bearing box 64 is pivoted about its pivot 64*a*, thereby moving and adjusting the position of roll 6. It is the purpose of screw 63 to adjust the relationship and position of roll 6 with respect to roll 5. The adjustment in the position of the axle 96 and thereby of roll 6 itself will slightly swing arm 61 with respect to the fixed axis pivot C, but will not affect the position of any of the other rolls.

Similar to set screw 43 for roll 4, there is a set screw 90 for roll 6, which threadedly passes through the projection 98 on arm 61 and engages stop 12. Tightening and loosening of set screw 90 adjusts the position of arm 61 and thereby of roll 6 with respect to cylinder 1. It is the purpose of screw 90 to adjust the pressure against cylinder 1 of roll 6.

Control over the position of roll 2 is slightly different from the control over the positions of rolls 4 and 6. Roll 2 has its semi-circular bearing box 26 which is swingably pivotable about the pivot 26*a* located on arm 21. The locking counter screw 25 supported (by means not shown) holds the axle 101 of roll 2 securely in the semi-circular opening of bearing box 26. Set screw 24 threadedly passes through the projection 21*a* provided on arm 21 and the set screw bears against an end of bearing box 26. Tightening and loosening of set screw 24 correspondingly shifts the position of roll 2 with respect to cylinder 1. It is the purpose of screw 24 to adjust the relationship and position of roll 2 with respect to rolls 3 and 5.

Further control over the position of roll 2 is obtained with the cooperation of neighboring stationary axis pivot C. Roll 5 moves around a bearing 52*b*, which bearing is stationary with respect to pivot C. Mounted alongside roll 5 is the movable ring-like plate 52*a*. One end of the plate includes the stop 13 whih engages the rounded surface 86 on arm 21. At the other end of plate 52*a* is a set screw supporting projection 102 which threadedly receives the set screw 52. The tip of the set screw 52 bears against the aforesaid bearing 52*b* of the axle of roll 5. Adjustment by tightening and loosening of set screw 52 at its head shifts the associated plate 52*a* with respect to pivot C, and thereby shifts the position of stop 13, which causes corresponding motion of arm 21 and thereby causes shifting of roll 2 with respect to cylinder 1. The clearance opening 103 through plate 52*a* and around pivot C permits the desired shifting of plate 52*a* without interference. As with rolls 4 and 6, adjustment in the position of roll 2 by either of the means provided for that purpose does not affect the position of any of the other rolls.

With the arrangement involving three form rolls and two distribution rolls as discussed herein, there are four contact points between the distribution and form rolls, having significant benefits in the ink distribution characteristics thereof. The positions of the rolls although somewhat adjustable are always intended to be such that a quadrangle is defined including at its corners the axes of transfer roll A, of distribution rolls 3 and 5 and of any one of form rolls 4, 2 and 6.

Although the present invention has been described in connection with a preferred embodiment thereof, many variations and modifications will now become apparent to those skilled in the art. It is preferred, therefore, that the present invention be limited not by the specific disclosure herein, but only by the appended claims.

I claim:

1. An inking apparatus for uniformly inking a rotatable cylinder, comprising:

a support frame;

first, second and third rotatable form rolls, aligned with each other and spaced apart from but near to each other and arrayed around said cylinder and all rollingly engaging said cylinder; a respective first, second and third pivot on which said first, second and third rolls are rotatably mounted, and the locations of these said pivots being adjustable;

fourth and fifth rotatable distribution rolls, aligned with each other and also with said form rolls; said distribution rolls being spaced from each other; a fourth pivot on which said fourth roll is rotatably mounted; the location of said fourth pivot being adjustable; a fifth pivot on which said fifth roll is rotatably mounted; said fifth pivot being fixedly located with respect to and attached to said frame;

said fourth distribution roll being continuously in engagement with both said first and said second form rolls for rolling therewith; said fifth distribution roll being continuously in engagement with both of said second and said third form rolls for rolling therewith; whereby there are four continuously engaged contact points between said form rolls and said distribution rolls for effective ink distribution;

a sixth rotatable transfer roll for receiving ink from a source, a sixth pivot on which said sixth roll is rotatably mounted; said sixth roll being spring biased against said fourth and fifth distribution rolls and the location of said sixth roll being self adjustable against said fourth and fifth rolls and in continuous engagement with both said fourth and fifth rolls for their rolling together;

a seventh pivot generally aligned with said sixth pivot and being fixedly located with respect to and attached to said frame;

a first arm journaled for swinging motion about said seventh fixed pivot and extending toward said fourth pivot; said fourth pivot being located on said first arm, and said fourth roll being carried on said first arm and being rotatable with respect thereto;

a second arm journaled for swinging motion about said fourth pivot and extending toward said first pivot; said first pivot being located on said second arm and said first roll being carried on said second arm and being rotatable with respect thereto;

a third arm journaled for swinging motion about said fourth pivot and extending toward said second pivot; said second pivot being located on said third arm and said second roll being carried on said third arm and being rotatable with respect thereto;

a fourth arm journaled for swinging motion about said fifth pivot and extending toward said third pivot; said third pivot being located on said fourth arm and said third roll being carried on said fourth arm and being rotatable with respect thereto;

a plurality of biasing means for biasing said form rolls into engagement with said cylinder, for biasing said fourth distribution roll into engagement with said first and second form rolls and for biasing said second roll into engagement with said fifth roll;

respective first, second and third form roll position readjustment means connected with the respective one of said form rolls for moving the position of the respective said form rolls;

respective first, second and third stop means connected with the respective one of said form rolls for holding the position of that said form roll and its respective said arm stationary as any other said form roll and its said arm shifts in position.

2. The inking apparatus of claim 1, wherein throughout all adjustments in the positions of said rolls, said sixth, fourth, fifth and any one of said first, second and third pivots define a quadrangle.

3. The inking apparatus of claim 1, wherein each said form roll position adjustment means comprises respective means for pivoting the respective said arm to which that said roll is pivotably connected, without pivoting the other said arms, and for said first and said second form rolls, it also comprises means for pivoting said first arm around said pivot;

each said stop means comprises a respective first, second, third and fourth stop element respectively located on the respective said arm carrying its said roller and each engaging said frame in a manner that prevents further movement of that said stop, and said biasing means for said form rolls biasing said stop elements against said frame.

4. The inking apparatus of claim 3, further comprising a stop element abutment framework located alongside said cylinder and being nonmovably connected with said frame; said first, second and fourth stop elements being in engagement with said abutment framework and said third stop element being in abutting engagement with said fifth pivot.

5. The inking apparatus of claim 4, wherein all said stop elements are adjustable, thereby to adjust the positions of the associated said rolls.

* * * * *